United States Patent [19]

Lepp

[11] 4,381,704

[45] May 3, 1983

[54] METHOD AND APPARATUS FOR REMOVING IRREGULAR LAP FORMATIONS IN COILS OF METAL STRIP

[75] Inventor: Raymond J. Lepp, Flossmoor, Ill.

[73] Assignee: Inland Steel Company, Chicago, Ill.

[21] Appl. No.: 254,482

[22] Filed: Apr. 15, 1981

[51] Int. Cl.[3] ..... B30B 13/00

[52] U.S. Cl. ..... 100/35; 100/215; 100/295

[58] Field of Search ..... 100/3, 35, 295, 214, 100/215, 218, 231, 7, 12, 77, 78, 88, 173, 175; 53/118; 242/1, 55; 264/281, 339, 285, 160

[56] References Cited

U.S. PATENT DOCUMENTS

| | | | |
|---|---|---|---|
| 3,129,658 | 4/1964 | Valente | 100/218 |
| 3,165,444 | 7/1965 | McLean | 100/7 |
| 3,400,652 | 9/1968 | Hill et al. | 100/7 |
| 3,406,600 | 10/1968 | Minick | 242/55 X |
| 3,675,568 | 7/1972 | Martelee | 100/7 |
| 3,788,210 | 1/1974 | Lingemann | 100/7 |
| 3,974,761 | 8/1976 | Hill | 100/7 |
| 4,024,805 | 5/1977 | Glasson | 100/12 |
| 4,301,720 | 11/1981 | Elineau | 100/3 |

*Primary Examiner*—Billy J. Wilhite

*Attorney, Agent, or Firm*—Merriam, Marshall & Bicknell

[57] ABSTRACT

Irregular lap formations, such as telescoping, are removed by sandwiching the coil between two horizontally spaced, vertically disposed members each engaging lap edges on respective opposite sides of the coil and then moving at least one of these members toward the other.

13 Claims, 5 Drawing Figures

FIG.1
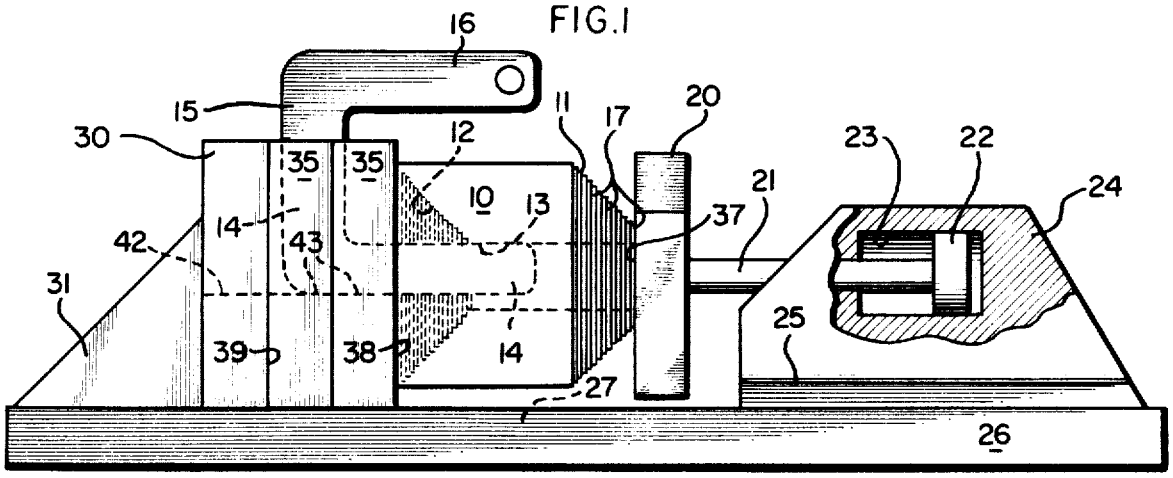
FIG.2
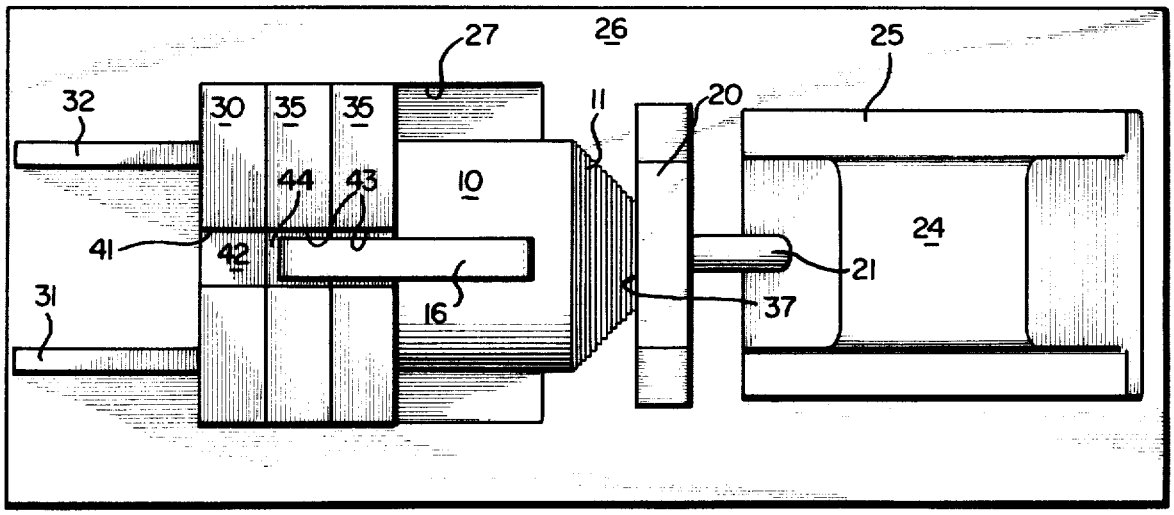
FIG. 3
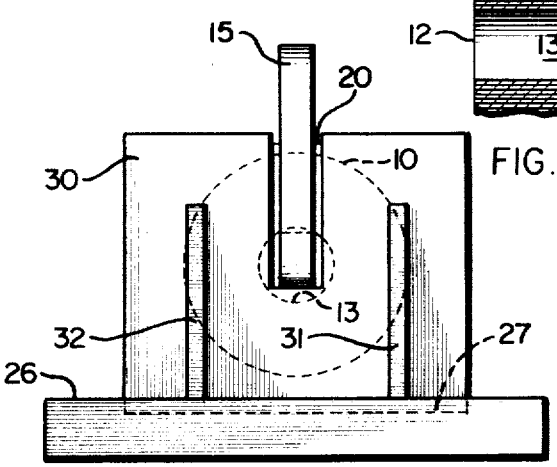
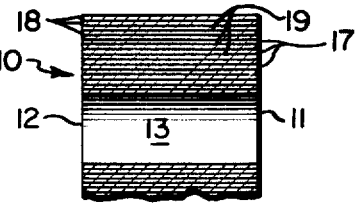
FIG.5
FIG.4
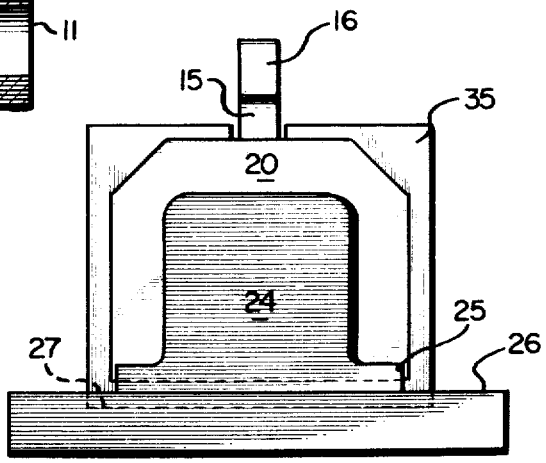

METHOD AND APPARATUS FOR REMOVING IRREGULAR LAP FORMATIONS IN COILS OF METAL STRIP

BACKGROUND OF THE INVENTION

The present invention relates generally to methods and apparatus for processing coils of metallic strip material, such as steel strip, and more particularly to a method and apparatus for removing irregular lap formations in such a coil.

In a coil of strip material, the strip is wound in laps of progressively increasing diameter. Each lap has two edges, one on each side of the coil. In a coil with regular lap formations, the edge on a given side of a lap is aligned with the corresponding edges of the same side of the other laps, and the coil side is flat. In a coil having irregular lap formations, the edges of at least some laps extend outwardly, in an axial direction of the coil a distance different than other lap edges on the same side of the coil. An irregular lap formation in a coil may manifest itself as telescoping laps, undulating laps or staggered laps, for example.

Many users of coiled metallic strip material cannot use coils having irregular lap formations. This is because the equipment they use to unwind and otherwise process the coils are not intended to operate on coils having irregular lap formations, and the strip in such coils will be damaged at the edges when processed by this equipment. This problem is virtually nonexistent for coils with regular lap formations.

In the past, when the problem of irregular lap formations arose, the entire coil was unwound and then rewound with particular care to assure that the rewound coil had regular lap formations. This was a difficult and time-consuming process. Moreover, when the metallic strip material was thick, e.g., ½ inch thick steel strip or the like, unwinding and rewinding was not practicable because the material was too heavy. When originally wound, this material was still hot, and thus it was much easier to coil than when cold.

Another disadvantage to coils having irregular lap formations is that the lap edges are much more readily damaged during transportation and handling than coils with regular lap formations.

SUMMARY OF THE INVENTION

The problems arising with coils having irregular lap formations are eliminated by the method and apparatus in accordance with the present invention which remove the irregular lap formations in the coil.

This is accomplished by placing the coil having the irregular lap formations between a pair of horizontally spaced, vertically disposed members or plates, each located on a respective opposite side of the coil. The coil is sandwiched between these two members so that one of the members engages the most outwardly extending lap edge on one side of the coil and the other of the members engages the most outwardly extending lap edge on the other side of the coil. One of the two sandwiching members is connected to a mechanism, such as a hydraulic ram, which will move that member in a direction along the axis of the coil. The other member is stationary.

The hydraulic ram is actuated to move the one member toward the other member to decrease the distance between the two members which, in turn, push axially inwardly the most outwardly extending lap edge on each side, thereby to eliminate the differences in the distances to which the lap edges extend on each side of the coil. As the one member continues its movement toward the other member, it successively engages the next most outwardly extending lap edge on one side of the coil, while maintaining the engagement with the previously engaged lap edges on that side. Similarly, the other member successively engages the next most outwardly extending lap edge on its side of the coil while maintaining the engagement with the previously engaged lap edges on that side.

The coil is initially placed in position between the two sandwiching members with a C-hook. The C-hook also supports the coil from above during the operation in which the irregular lap formations are removed. To accommodate the C-hook, the stationary sandwiching member has a vertically disposed notch with an open upper end. This notch receives that part of the C-hook which extends outwardly from the coil when the latter is supported by the C-hook during the operation in which the irregular lap formations are removed.

The C-hook supports the coil from above in a manner which permits movement on the laps in an axial direction during the operation which removes the irregular lap formations.

Other features and advantages are inherent in the structure claimed and disclosed or will become apparent to those skilled in the art from the following detailed description in conjunction with the accompanying diagrammatic drawings.

BRIEF DESCRIPTION OF THE DRAWINGS

FIG. 1 is a side view of an embodiment of apparatus in accordance with the present invention;

FIG. 2 is a plan view of the apparatus of FIG. 1;

FIG. 3 is an end view from the rear of the apparatus; and

FIG. 4 is an end view from the front of the apparatus.

FIG. 5 is a fragmentary sectional view of a coil of metallic strip material.

DETAILED DESCRIPTION

Referring initially to FIGS. 1, 2, and 5, indicated at 10 is a coil of metallic strip material, such as steel strip. Coil 10 has a plurality of laps 19,19 each having a pair of opposite edges 17,18. Coil 10 is shown with a regular lap formation in FIG. 5. In FIGS. 1 and 2, coil 10 has an irregular lap formation called "telescoping," with the laps bulging outwardly at one side 11 of the coil and recessed inwardly on the other side 12 of the coil. Some of the lap edges 17,17 on side 11 extend outwardly in an axial direction, a distance different than the edges 17,17 of other laps on side 11. Similarly, some of the recessed lap edges on side 12 are disposed axially inwardly a distance different than the edges of other laps on side 12.

Coil 10 is supported by a C-hook having a lower horizontally extending portion 14 which engages within an axial opening 13 in coil 10. C-hook portion 14 has one end integral with the lower end of a vertical C-hook portion 15 having its upper end integral with one end of an upper horizontally extending C-hook portion 16. C-hook portion 16 is connected to an overhead crane or the like (not shown).

Located adjacent one side 11 of coil 10 is one member or plate 20 connected by a shaft 21 to a piston 22 located inside the cylinder 23 of a hydraulic ram comprising a housing 24 extending upwardly from a lower flange 25 mounted on a machinery base 26 having a recess 27 in its upper surface. Also mounted on machinery base 26 is a stationary backing member 30 reinforced with buttresses 31,32 extending between the upper surface of machinery base 26 and the rear surface of stationary backing member 30. Located between stationary backing member 30 and the other side 12 of coil 10 are a pair of stationary spacer members 35,35 each having a bottom portion received within recess 27 of machinery base 26.

Member 20, by virtue of its attachment to the hydraulic ram, is a moveable member, and member 20 has an inner surface 37 for engaging the most outwardly extending lap edge on side 11 of coil 10.

Backing member 30 and spacer members 35,35 are stationary members. Spacer member 35 has an inner surface 38 for engaging the most outwardly extending lap edge on side 12 of coil 10. The inner surface 39 on stationary backing member 30 would perform the same function as the inner surface 38 on spacer member 35 if coil 10 had an axial dimension sufficiently long so that side 12 thereof would be engaged by the inner surface 39 on backing member 30 without the interposition of spacer members 35,35 between backing member 30 and coil side 12.

Stationary backing member 30 has a vertically disposed notch 41 with an open upper end and a bottom 42. Each spacer member 35,35 has a vertically disposed notch 43 with an open upper end and a bottom 44. Notches 41,43 accommodate portions 14,15 of the C-hook while the latter supports coil 10 between moveable member 20 and stationary members 30,35. Notches 41,43 are vertically coextensive and mutually aligned.

The irregular lap formations in coil 10 are eliminated, using the equipment illustrated in the figures and a method in accordance with the present invention, to be described below. Initially, coil 10 and the C-hook are located in the position illustrated in the figures utilizing an overhead crane or the like (not shown). Coil 10 is supported and maintained in a position for removing the irregular lap formations in the coil by the C-hook.

More particularly, coil 10 is placed between a pair of horizontally spaced, vertically disposed members 20,35 each located on a respective opposite side 11,12 of the coil. In this position, the lower horizontally extending C-hook portion 14 of the C-hook rests on notch bottoms 44,44 in notches 43,43 of spacer members 35,35. Vertically extending C-hook portion 15 extends upwardly within notches 43,43 of the spacer members.

The hydraulic ram is actuated to bring inner surface 37 on moveable member 20 into engagement with the outer most lap edge 17 on side 11 of the coil. Movement of the hydraulic ram and moveable member 20 continues in an axially inward direction relative to coil 10 until the inner surface 38, on that spacer member 35 nearest to coil 10, engages the most outwardly extending lap edge on side 12 of coil 10.

At this stage of the operation, the coil laps are still in the same irregular formation which existed before the coil was placed between members 20 and 35. However, as moveable member 20 continues to move in an axially inward direction relative to coil 10, the inner surface 37 thereof successively engages the next most outwardly extending lap edge 17 on side 11 of the coil while maintaining the engagement with the previously engaged lap edges 17 on side 11. Similarly, as member 20 moves toward members 30,35, the inner surface 38 on the member 35 most closely adjacent coil 10 successively engages the next most outwardly extending lap edge on side 12 of the coil while maintaining its engagement with the previously engaged lap edges on side 12. The end result is a straightening out of the lap formations.

As the irregular lap formation is removed, there is a relative outward axial movement of the indented lap edges on side 12 of the coil, to the left as viewed in FIG. 1, and there is a relative inward axial movement of the protruding lap edges on side 11 of the coil to the right as viewed in FIG. 1. At the same time, there will be some circumferential movement of the lap surfaces, i.e., a slight unwinding movement.

During the straightening operation, initially, only one lap edge at each side 11,12 of the coil is engaged by a member 20 or 35 so that there is minimal frictional resistance to unwinding. As the operation progresses, more lap edges are progressively engaged, but the need to unwind further to accommodate the straightening operation also decreases progressively.

The engagement of the lower horizontally extending C-hook portion 14 within the axial opening 13 of coil 10 permits axial movement of the coil laps during the straightening operation.

The method and apparatus described above are particularly useful on coils of steel strip, either hot rolled or cold rolled or pickled and annealed.

As shown in the figures, the notches permit vertical withdrawal of the C-hook and the coil supported thereon, at the conclusion of the straightening operation, without first substantially displacing the C-hook and coil in an axial direction relative to the notched members 30, 35.

The foregoing detailed description has been given for clearness of understanding only, and no unnecessary limitations should be understood therefrom, as modifications will be obvious to those skilled in the art.

I claim:

1. A method for straightening irregular lap formations in a coil of metallic strip material wherein, on each side of the coil, the edges of at least some laps extend in an axial direction a distance different than the edges of other laps, there being no axial spaces in said coil, said method comprising the steps of:

placing said coil between a pair of spaced-apart members each located on a respective opposite side of the coil;

engaging one of said members with the most outwardly extending lap edge on one side of the coil, around the entire periphery of the lap, and engaging the other of said members with the most outwardly extending lap edge on the other side of the coil;

moving one of said members toward the other member to decrease the distance therebetween and to eliminate the differences in the distances to which said lap edges extend on each side of the coil in response to said movement of said member;

supporting said coil along its axis in a manner which permits movement of said laps in an axial direction during movement of said member;

and vertically withdrawing said supported coil, at the conclusion of said straightening operation, without initially employing a substantial relative displacement in an axial direction between said supported coil and said other member.

2. A method as recited in claim 1 wherein:

said members are horizontally spaced and vertically disposed.

3. A method as recited in claim 2 and comprising:

supporting said coil from above with a C-hook;

and providing said other member with a vertically disposed notch having an open upper end, for accommodating said C-hook while the latter supports said coil.

4. A method as recited in claim 3 and comprising:

emplacing a stationary backing member behind said other member on a side opposite that which engages said coil;

providing said stationary backing member with a vertically disposed notch having an open upper end and vertically coextensive with said notch on said other member;

and aligning said notch on said other member with said notch on said stationary member.

5. A method as recited in claim 1 and comprising:

maintaining said other member stationary during the moving of said one member.

6. A method as recited in claim 1 and comprising:

successively engaging the next most outwardly extending lap edge on said one side of the coil around the entire periphery of the lap, with said one member as the latter moves toward the other member while maintaining the engagement of said one member with the previously engaged lap edges on the one side, around the entire periphery of said previously engaged laps.

7. A method as recited in claim 6 and comprising:

successively engaging the next most outwardly extending lap edge, on said other side of the coil, with said other member as the one member moves toward said other member, while maintaining the engagement of said other member with the previously engaged lap edges on said other side.

8. An apparatus for straightening irregular lap formations in a coil of metallic strip material wherein, on each side of the coil, the edges of at least some laps extend outwardly in an axial direction a distance different than the edges of other laps, there being no axial spacing in said coil, said apparatus comprising:

a pair of horizontally spaced, vertically disposed members for receiving said coil therebetween;

means on one of said members for engaging the most outwardly extending lap edge on one side of the coil, around the entire periphery of the lap;

means on the other of said members for engaging the most outwardly extending lap edge on the other side of the coil;

means for moving one of said members toward the other member to decrease the distance therebetween;

said engaging means on said members comprising means for eliminating the differences in the distances to which said lap edges extend on each side of the coil in response to the movement of said one member;

means for supporting said coil along its axis in a manner which permits movement of said laps in an axial direction during movement of said members;

said supporting means and said other member comprising means cooperating to permit the vertical withdrawal of said supported coil, at the conclusion of the straightening operation, without initially employing a substantial relative displacement in an axial direction between said supported coil and said other member.

9. An apparatus as recited in claim 8 wherein:

said means for supporting said coil from above comprises a C-hook;

and said other member has a vertically disposed notch with an open upper end, for accommodating said C-hook while the latter supports said coil.

10. An apparatus as recited in claim 9 and comprising:

a stationary backing member located behind said other member on a side opposite that which engages said coil;

said stationary backing member having a vertically disposed notch with an upper end, said notch on the stationary backing member being vertically coextensive with said notch on said other member;

said notch on said other member being aligned with said notch on said stationary member.

11. An apparatus as recited in claim 8 and comprising:

means for maintaining said other member stationary during the moving of said one member.

12. An apparatus as recited in claim 8 wherein said one member comprises:

means for successively engaging the next most outwardly extending lap edge, on said one side of the coil, around the entire periphery of the lap, as the one member moves toward the other member while maintaining the engagement of said one member with the previously engaged lap edges on the one side around the entire periphery of the previously engaged laps.

13. An apparatus as recited in claim 12 wherein said other member comprises:

means for successively engaging the next most outwardly extending lap edge, on said other side of the coil, as the one member moves toward said other member, while maintaining the engagement of said other member with the previously engaged lap edges on said other side.

* * * * *